US010837721B2

(12) United States Patent
Ives

(10) Patent No.: US 10,837,721 B2
(45) Date of Patent: Nov. 17, 2020

(54) INTERCHANGEABLE MAGAZINE WELL

(71) Applicant: David Alan Ives, Bowling Green, KY (US)

(72) Inventor: David Alan Ives, Bowling Green, KY (US)

(73) Assignee: David Ives, Bowling Green, KY (US)

( * ) Notice: Subject to any disclaimer, the term of this patent is extended or adjusted under 35 U.S.C. 154(b) by 0 days.

(21) Appl. No.: 16/284,003

(22) Filed: Feb. 25, 2019

(65) Prior Publication Data

US 2020/0271403 A1 Aug. 27, 2020

Related U.S. Application Data

(60) Provisional application No. 62/645,605, filed on Mar. 20, 2018.

(51) Int. Cl.

| | |
|---|---|
| ***F41A 3/66*** | (2006.01) |
| ***F41A 11/02*** | (2006.01) |
| ***F41A 9/71*** | (2006.01) |

(52) U.S. Cl.
CPC *F41A 3/66* (2013.01); *F41A 9/71* (2013.01); *F41A 11/02* (2013.01)

(58) Field of Classification Search
CPC ..... F41A 3/66; F41A 11/02; F41A 11/00
See application file for complete search history.

(56) References Cited

U.S. PATENT DOCUMENTS

| | | | | |
|---|---|---|---|---|
| 5,900,577 | A * | 5/1999 | Robinson | F41A 11/02 89/156 |
| 7,131,228 | B2 * | 11/2006 | Hochstrate | F41C 23/16 42/75.01 |
| 7,802,392 | B2 * | 9/2010 | Peterson | F41C 23/14 42/75.03 |
| 7,810,271 | B2 * | 10/2010 | Patel | F41A 11/02 42/75.03 |
| 8,429,844 | B2 * | 4/2013 | Dextraze | F41A 3/18 42/73 |
| 8,769,854 | B1 * | 7/2014 | Battaglia | F41A 3/66 42/71.01 |

(Continued)

OTHER PUBLICATIONS

Jeremy, S., "Nordic Components Pistol Caliber Carbine: Gun Review", https://www.thetruthaboutguns.com/nordic-components-pistol-caliber-carbine-gun-review/ (Year: 2017).*

(Continued)

*Primary Examiner* — Joshua T Semick

(57) ABSTRACT

A single bolt-action receiver with a lower having the ability to accept multiple shaped magazines through an interchangeable magazine well, defining a magazine chamber shape. The interchangeable magazine wells may further comprise a first flange and a first aperture and a second flange and a second aperture. The first interchangeable magazine well defining a first magazine chamber shape, may be configured to receive a first ammunition magazine containing a first shape and first caliber ammunition. The first interchangeable magazine well can be removed and a second interchangeable magazine well containing a second chamber shape, may be configured to receive a second ammunition magazine shape containing a second shape and second caliber ammunition.

4 Claims, 5 Drawing Sheets

(56) References Cited

U.S. PATENT DOCUMENTS

| | | | | |
|---|---|---|---|---|
| 9,091,505 | B1 * | 7/2015 | Battaglia | F41C 23/20 |
| 9,459,060 | B2 * | 10/2016 | Langevin | F41A 3/66 |
| 9,631,885 | B2 * | 4/2017 | Jones | F41A 11/02 |
| 9,766,029 | B2 * | 9/2017 | Dextraze | F41A 29/00 |
| 10,215,517 | B2 * | 2/2019 | McCallum | F41A 19/10 |
| 2009/0071053 | A1 * | 3/2009 | Thomele | F41A 11/02 42/1.01 |

OTHER PUBLICATIONS

"Magpul Hunter Stock Magazine Well Kit Remington 700 Long Action Magnum 5 Round AICS Style Magazine Matte Black MAG569-BLK", https://www.cheaperthandirt.com/magpul-hunter-stock-magazine-well-kit-remington-700-long-action-magnum-5-round-aics-style-magazine-matte-black-mag569-blk/FC-840815109648.html, (Year: 2019).*

"Saber Modular Rie Chassis Systems Now Manufactured for Savage Model 10 & 110 Rifles", https://www.ammoland.com/2014/01/saber-modular-rifle-chassis-systems-for-savage-rifles/, (Year: 2014).*

* cited by examiner

INTERCHANGEABLE MAGAZINE WELL

FIELD

The present disclosure relates to firearms, and more specifically, to firearms comprising an interchangeable magazine well system, method, and apparatus.

BACKGROUND

Typical bolt-action firearms contain one magazine well capable of receiving a specific ammunition magazine corresponding to a specific shape and caliber of ammunition. Typically, this means that each bolt-action firearm is only capable of firing a single shape kind caliber of ammunition. As a result, firearm users wishing to fire several different shapes and calibers of ammunitions are unable to do so absent utilizing multiple firearms.

SUMMARY

An interchangeable magazine well may comprise a magazine well housing defining a magazine chamber. The interchangeable magazine well may further comprise a first flange comprising a first aperture and a second flange comprising a second aperture and a geometric interface comprising a straight portion and a curved portion. The interchangeable magazine well chamber may be configured to receive a first ammunition magazine shape containing a first shape and first caliber ammunition and a second interchangeable magazine well chamber may be configured to receive a second ammunition magazine shape containing a second shape and caliber ammunition.

A lower receiver for a firearm may comprise an interchangeable magazine well, comprising a magazine well housing defining a magazine chamber shape, a first flange comprising a first aperture, a second flange comprising a second aperture and a geometric interface comprising a straight portion and a curved portion. The lower receiver may further comprise a front lug comprising a front lug groove and a front lug aperture and a trigger guard comprising a trigger guard aperture and a geometric interface comprising straight portion and a curved portion.

A method of assembling a firearm may comprise coupling a first interchangeable magazine well to a front lug and a trigger guard. The method may further comprise inserting a first ammunition magazine shape containing a first shape and first caliber ammunition into the first interchangeable magazine well. The method may further comprise removing the first ammunition magazine. The method may further comprise decoupling the first interchangeable magazine well from the front lug and the trigger guard. The method may further comprise coupling a second interchangeable magazine well to the front lug and the trigger guard. The method may further comprise inserting a second ammunition magazine shape containing a second caliber and second ammunition into the second interchangeable magazine well.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF TILE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In various embodiments, an interchangeable magazine well system is provided. The interchangeable magazine well system may be configured to allow a single firearm to fire a variety of ammunitions having different shapes and calibers. The interchangeable magazine well system may further be configured to allow a user to quickly transfer between multiple types of ammunition magazines with a single firearm.

Figure 1:
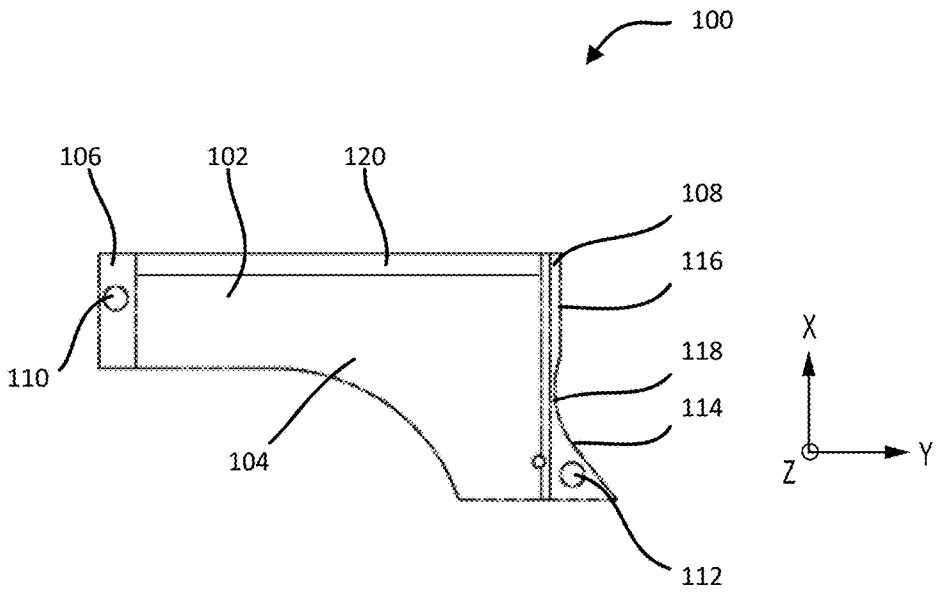
FIG. 1 illustrates an interchangeable magazine well, in accordance with various embodiments.

With reference to FIG. 1, interchangeable magazine well 100 may form a portion of a lower receiver for a firearm, such as a bolt-action firearm for example. Interchangeable magazine well 100 may be capable of receiving an ammunition magazine, which in turn, may transfer ammunition to a barrel chamber, thereby positioning the ammunition for impact and ignition. As will be discussed in greater detail below, interchangeable magazine well 100 may be one of many interchangeable magazine wells similar to interchangeable magazine well 100 capable of being exchanged and coupled to a single receiver or action flit.

With continued reference to FIG. 1, interchangeable magazine well 100 may comprise magazine well housing 102, in accordance with various embodiments. Magazine well housing 102 may be comprised of various materials, such as aluminum, aluminum alloys, titanium, titanium alloys, steel alloys, polymers, polymer compounds, a combination thereof, or any other material capable of withstanding forces associated with operation of a firearm. Magazine well housing 102 may be manufactured utilizing various processes. For example, magazine well housing 102 may be machined, molded, forged, stamped, produced by additive manufacturing techniques such as selective laser sintering (SLS), selective laser melting (SLM), electronic beam melting (EBM), casting, or any other suitable manufacturing technique. Magazine well housing 102 may define a magazine chamber 104 at an interior of magazine well housing 102. Magazine chamber 104 may be configured to receive and hold an ammunition magazine holding an ammunition of a specific shape and caliber. For example, in various embodiments, magazine chamber 104 may be configured to receive a single column or staggered column detachable box magazine, however, magazine chamber 104 is not limited in this regard and may be configured to receive and hold various other types of ammunition magazines.

In various embodiments, interchangeable magazine well 100 may further comprise a first flange 106 comprising a first aperture 110 and a second flange 108 opposite first flange 106 and comprising a second aperture 112. First flange 106 and second flange 108 may extend from magazine well housing 102 and comprise a width (measured perpendicular to the x-y plane) less than magazine well housing 102. Second flange 108 may comprise a geometric interface 114 comprising a straight portion 116 and curved portion 118. First aperture 110 and second aperture 112 may extend through magazine well housing 102 and be configured to receiver a mechanical fastener. As will be discussed with reference to FIG. 3, interchangeable magazine well 100 may further comprise a step 120 at its upper portion (in the y-direction), configured to mate with an upper receiver.

Figure 2:
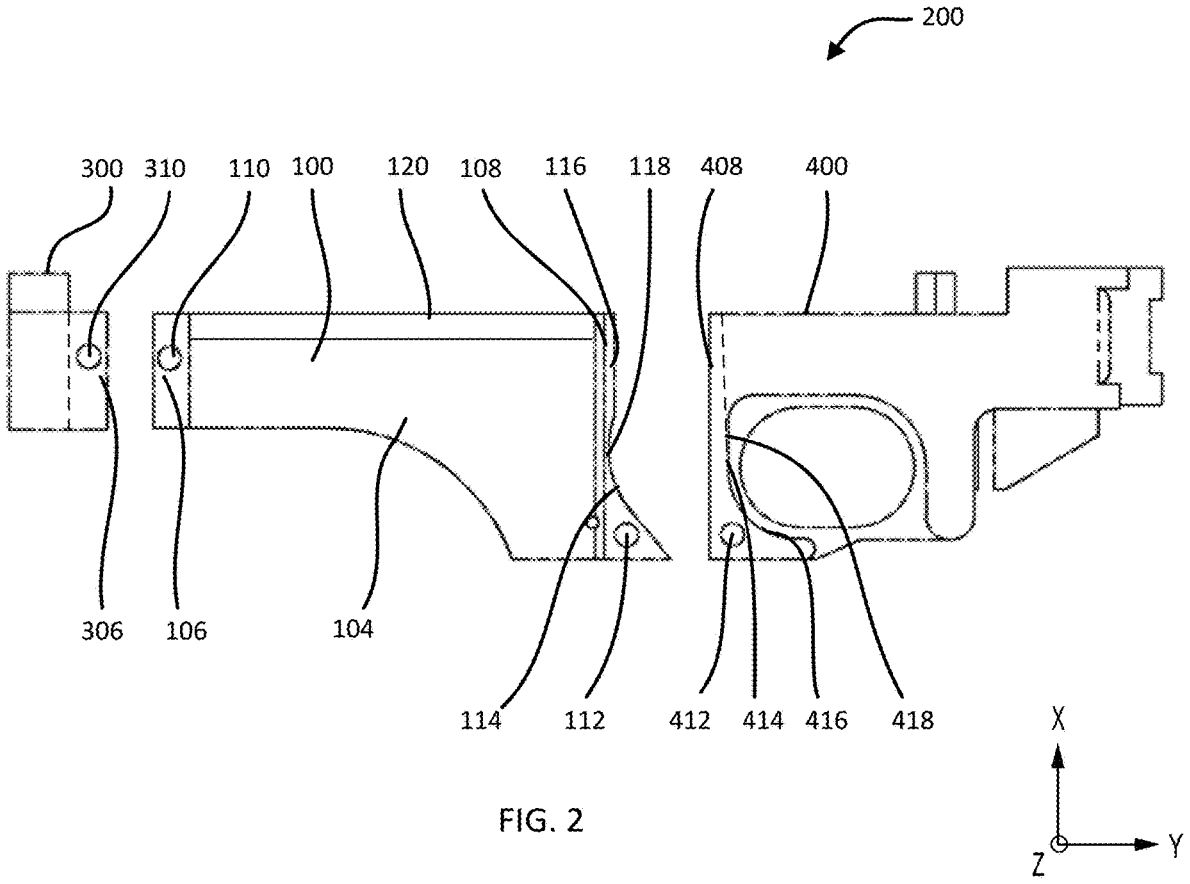
FIG. 2 illustrates an exploded view of a lower receiver of a firearm comprising an interchangeable magazine well, a front lug, and a trigger guard, in accordance with various embodiments.

With reference to FIG. 2, a lower receiver 200 of a firearm is illustrated in an exploded view with interchangeable magazine well 100, front lug 300, and trigger guard 400, in accordance with various embodiments. Lower receiver 200 with interchangeable magazine well 100, front lug 300, and trigger guard 400 may form a portion of a firearm receiver, along with an upper receiver or action (depicted in FIGS. 3-5) in various embodiments.

With continued reference to FIG. 2, front lug 300 may comprise a front lug aperture 310 and front lug groove 306, in accordance with various embodiments. Front lug aperture 310 may extend through each wall on either side of front lug groove 306 and be configured to receiver a mechanical fastener. Front lug groove 306 may have a groove depth measured in the x-direction, terminating at the dashed line in FIG. 2. The front lug groove depth may be approximately equal to a length of first flange 106, measured in the x-direction. Trigger guard 400 may comprise trigger guard groove 408, trigger guard aperture 412, and a geometric interface 414 comprising straight portion 416 and curved portion 418. Similar to front lug groove 306, trigger guard groove may have a groove depth measured in the x-direction, indicated by another dashed line. Trigger guard aperture 412 may extend through each wall formed by trigger guard groove 408 and be configured to receive a mechanical fastener.

During assembly of lower receiver 200, interchangeable magazine well 100 may be positioned such that first flange 106 is inserted into front lug groove 306. First aperture 110 may be aligned with front lug aperture 310 such that a mechanical fastener may be inserted through front lug aperture 310 and first aperture 110, thereby removably coupling interchangeable magazine well 100 to front lug 300. The alignment of interchangeable magazine well 100 and front lug 300 may be such that a distal portion (relative to a geometric center of interchangeable magazine well 100) of first flange 106 contacts an innermost portion of front lug groove 306 (as indicated by the dashed line). Stated otherwise, interchangeable magazine well 100 and front lug 300 may be coupled together such that there are no gaps between the components. An outer surface of interchangeable magazine well 100 may be flush with an outer surface of front lug 300 in the x-y plane.

Interchangeable magazine well 100 may further be positioned such that second flange 108 is inserted into trigger guard groove 408. Second aperture 112 may be aligned with trigger guard aperture 412 such that a mechanical fastener may be inserted through trigger guard aperture 410 and second aperture 112, thereby removably coupling interchangeable magazine well 100 to trigger guard 400. The alignment of interchangeable magazine well 100 and trigger guard 400 may be such that a distal portion (relative to a geometric center of interchangeable magazine well 100) of second flange 108 contacts an innermost portion of trigger guard groove 408. Stated otherwise, interchangeable magazine well 100 and trigger guard 400 may be coupled together such that there are no gaps between the components. An outer surface of interchangeable magazine well 100 may be flush with an outer surface of trigger guard 400 in the x-y plane. Straight portion 116 and curved portion 118 of interchangeable magazine well 100 may align with straight portion 416 and curved portion 418 of trigger guard 400, respectively, thereby further constraining the position of interchangeable magazine well 100 relative to trigger guard 400.

In various embodiments, interchangeable magazine well 100 may be coupled to front lug 300 and trigger guard 400 such that the first interchangeable magazine well 100 containing a first magazine chamber shape can be quickly and easily removed and replaced with another interchangeable magazine well containing second chamber shape. While the connection between interchangeable magazine well 100 and front lug 300 and trigger guard 400 is discussed above with reference to mechanical fastener, lower receiver 200 is not limited in this regard. En various other embodiments, interchangeable magazine well 100 may be removably coupled to front lug 300 and trigger guard 400 using various other processes as would be appreciated to one of skill in the art. In accordance with various other embodiments, interchangeable magazine well 100 may further comprise a pin, latch, button, screw, or other securing mechanism capable of coupling interchangeable magazine well to front lug 300 and trigger guard 400 and also capable of allowing removal of interchangeable magazine well 100 for changing the chamber shape.

Figure 3A:
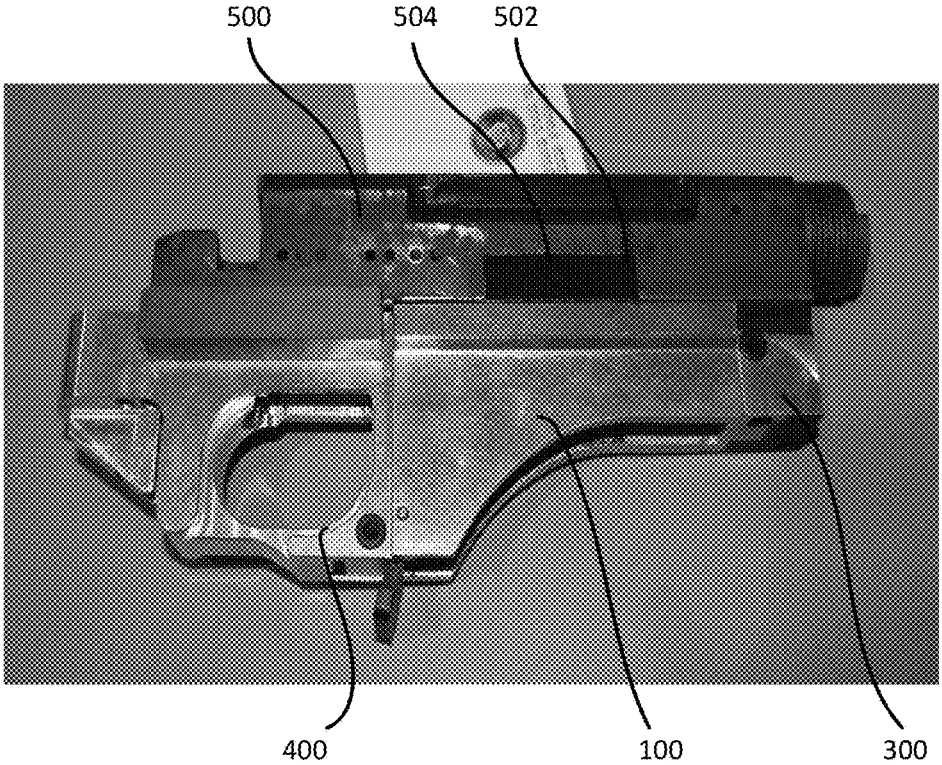
FIG. 3A is an image of an interchangeable magazine well coupled to a front lug, a trigger guard, and an upper receiver, in accordance with various embodiments.
Figure 3B:
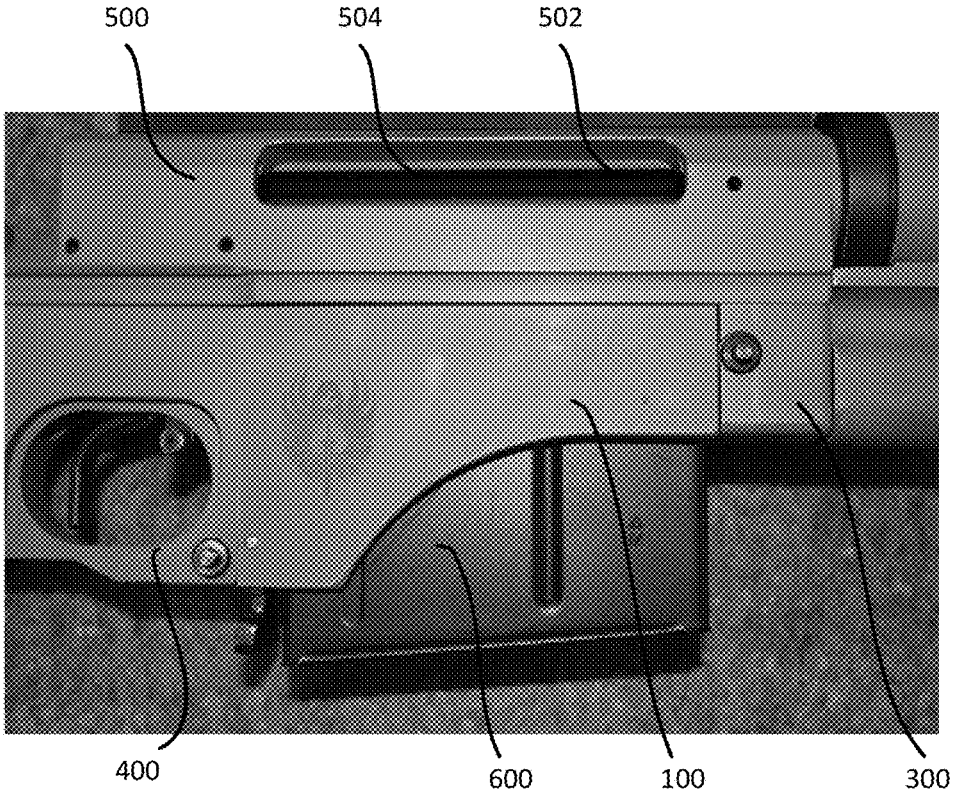
FIG. 3B is an image of an interchangeable magazine well coupled to a front lug, a trigger guard, and an upper receiver, in accordance with various embodiments.
Figure 4A:
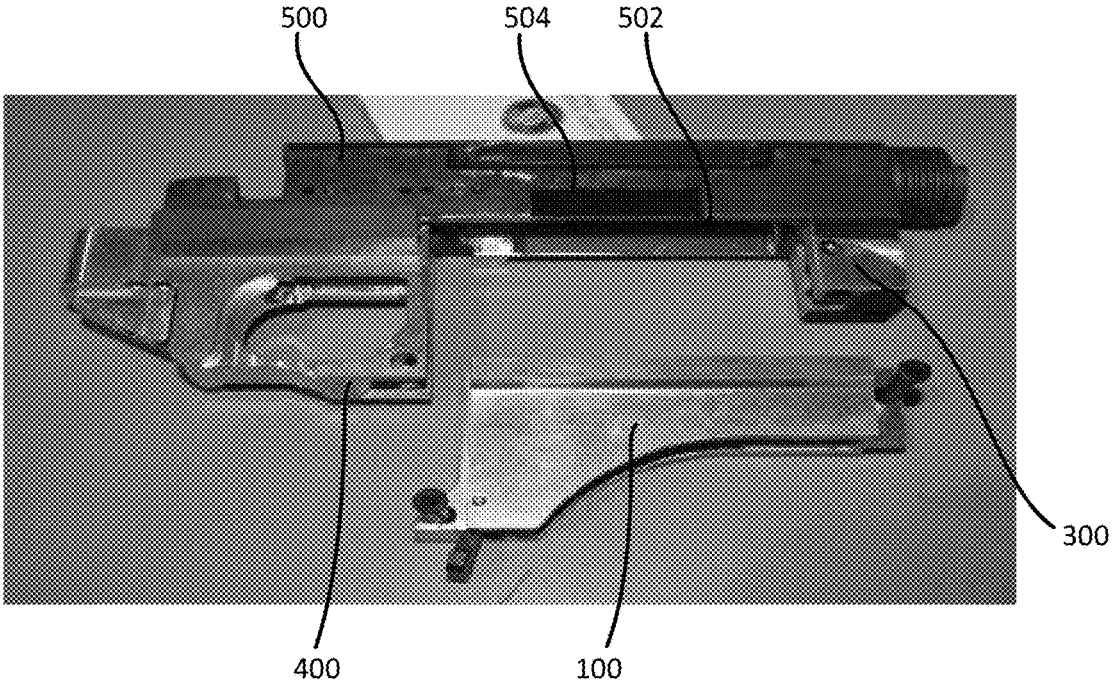
FIG. 4A is an image of an interchangeable magazine well detached from a front lug, a trigger guard, and an upper receiver in accordance with various embodiments.
Figure 4B:
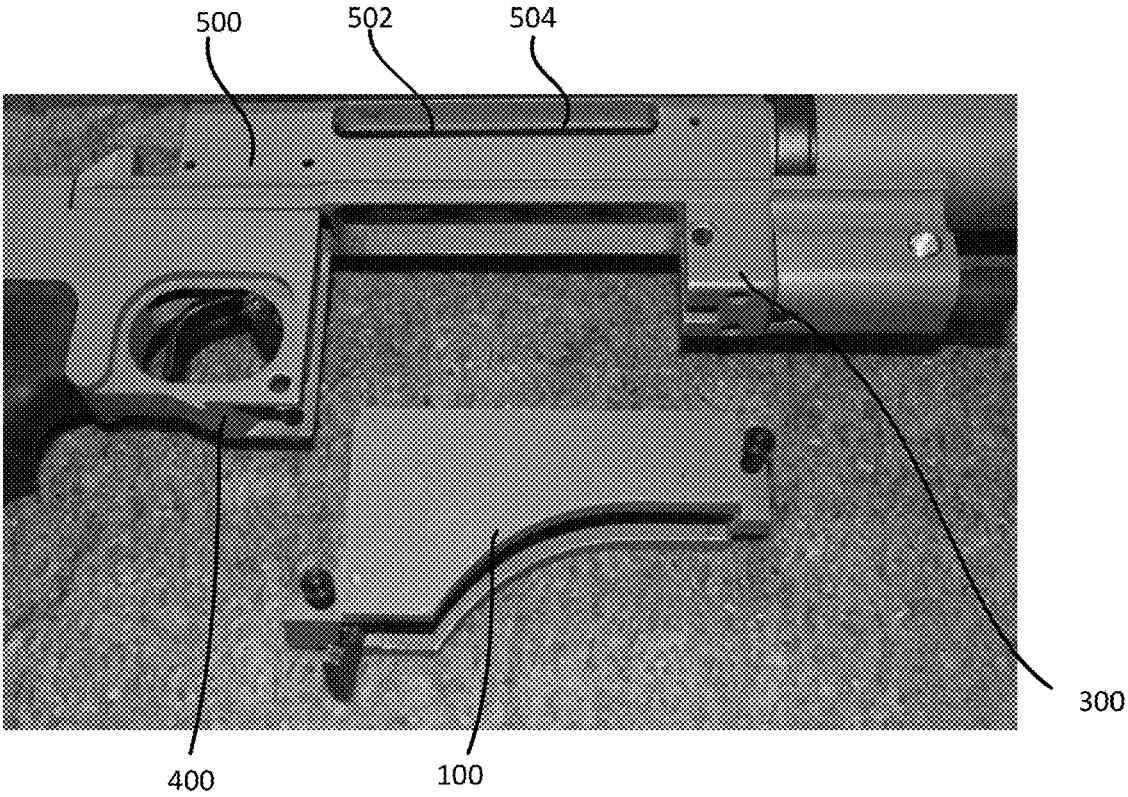
FIG. 4B is an image of an interchangeable magazine well detached from a front lug, a trigger guard, and an upper receiver in accordance with various embodiments.
Figure 5A:
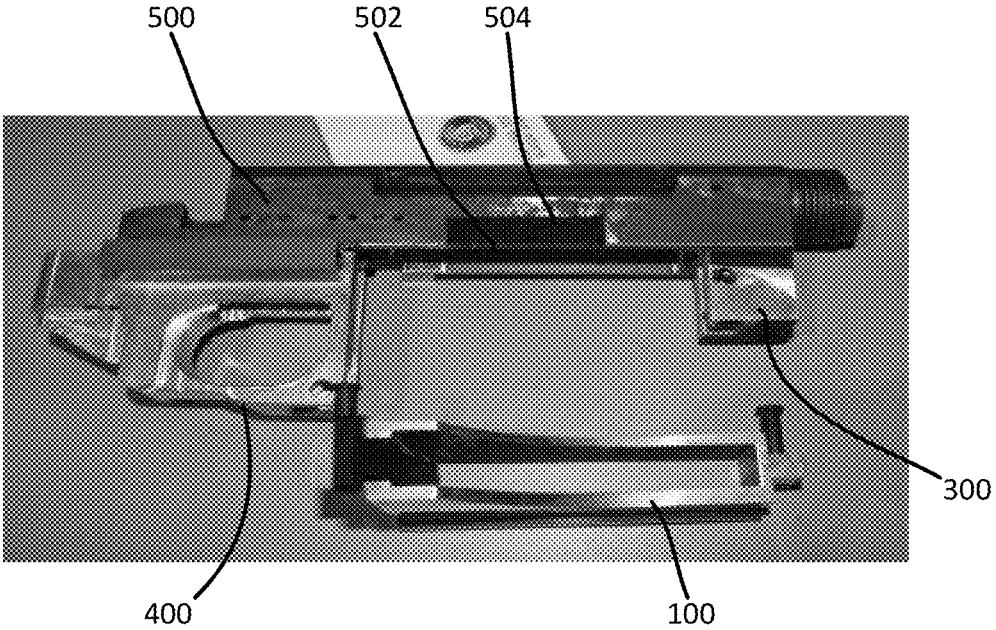
FIG. 5A is an image of an interchangeable magazine well detached and rotated 90 degrees from a front lug, a trigger guard, and an upper receiver in accordance with various embodiments.
Figure 5B:
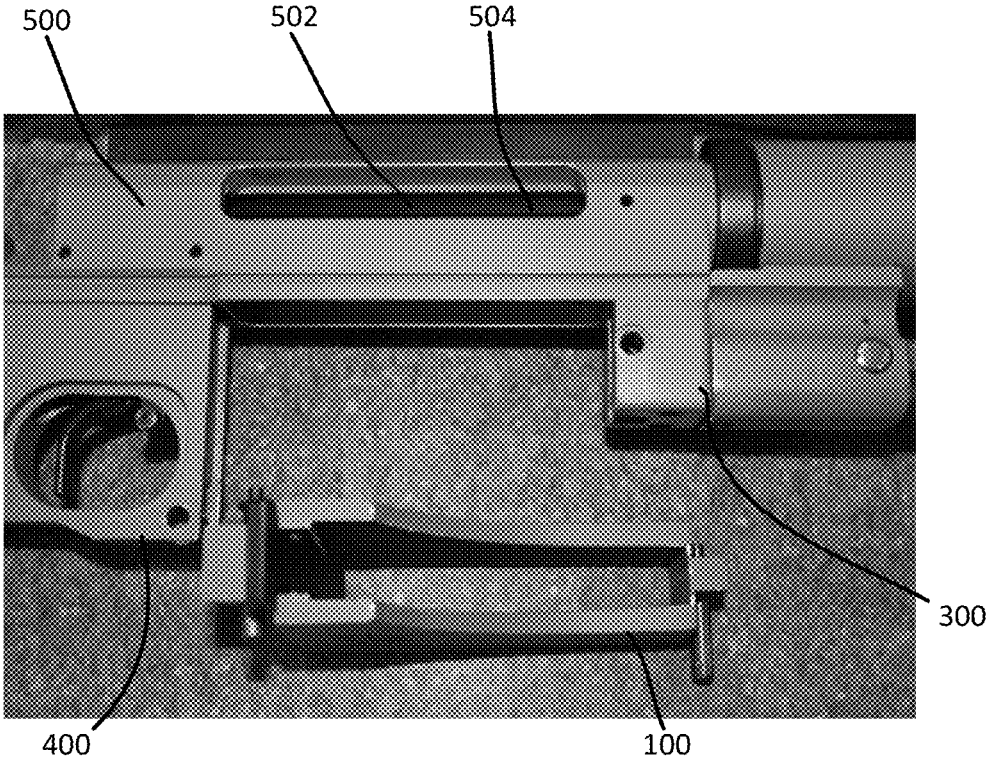
FIG. 5B is an image of an interchangeable magazine well detached and rotated 90 degrees from a front lug, a trigger guard, and an upper receiver in accordance with various embodiments.

Now with reference to FIGS. 3A, 3B, 4A, 4B, 5A, and 5B, various images of interchangeable magazine well 100, front lug 300, trigger guard 400, and an upper receiver 500 are shown. Upper receiver 500 may define a barrel chamber 502 at its interior surface configured to receive a round of ammunition. Upper receiver may further comprise an ejection port 504 configured to eject used ammunition round casings during operation of the firearm. As depicted in FIGS. 3A and 3B, interchangeable magazine well 100 may be removably coupled to front lug 300 and trigger guard 400 such that step 120 contacts and is flush with an outer surface of upper receiver 500. In various embodiments, front lug 300, trigger guard 400, and upper receiver 500 may be integral with each other. In other embodiments, front lug 300, trigger guard 400, and upper receiver 500 may be separate components coupled together such that each component can be removed similar to interchangeable magazine well 100. Interchangeable magazine well 100 may be configured to receive an ammunition magazine 600 (as depicted in FIG. 3B). Ammunition magazine 600 may be removably coupled to interchangeable magazine well 100 so that ammunition magazine 600 may be removed in order to refill or replace ammunition magazine 600. Ammunition magazine may be removably coupled to interchangeable magazine well 100 utilizing a button, lever, and/or switch. Upon the need for removal of ammunition magazine 600 from interchangeable magazine well 100, the user may actuate the button, lever, and/or switch, thereby releasing ammunition magazine 600 from interchangeable magazine well 100. Interchangeable magazine well 100 is shown decoupled from front lug 300, trigger guard 400, and upper receiver 500 in FIGS. 4A, 4B, 5A and 5B for further clarity.

Various embodiments of the present disclosure allow a single action or receiver to accommodate various calibers and shapes of ammunition. For example, in various embodiments, interchangeable magazine well 100 containing a first chamber shape may be designed to receive an ammunition magazine shape designed to hold a specific shape and caliber of ammunition. In the event a user of the firearm wishes to utilize a different magazine shape designed to hold another caliber or shape ammunition, the user may quickly remove the first interchangeable magazine well 100 and replace it with a second interchangeable magazine well containing a second chamber shape designed to receive a second ammunition magazine shape holding ammunition of a different shape or caliber. Accordingly, various embodiments of the present disclosure allow a single receiver or action to accommodate numerous magazine shapes and dimensions holding numerous caliber shapes of ammunition with limited time investment or structural modifications to the firearm.

Figure 6:
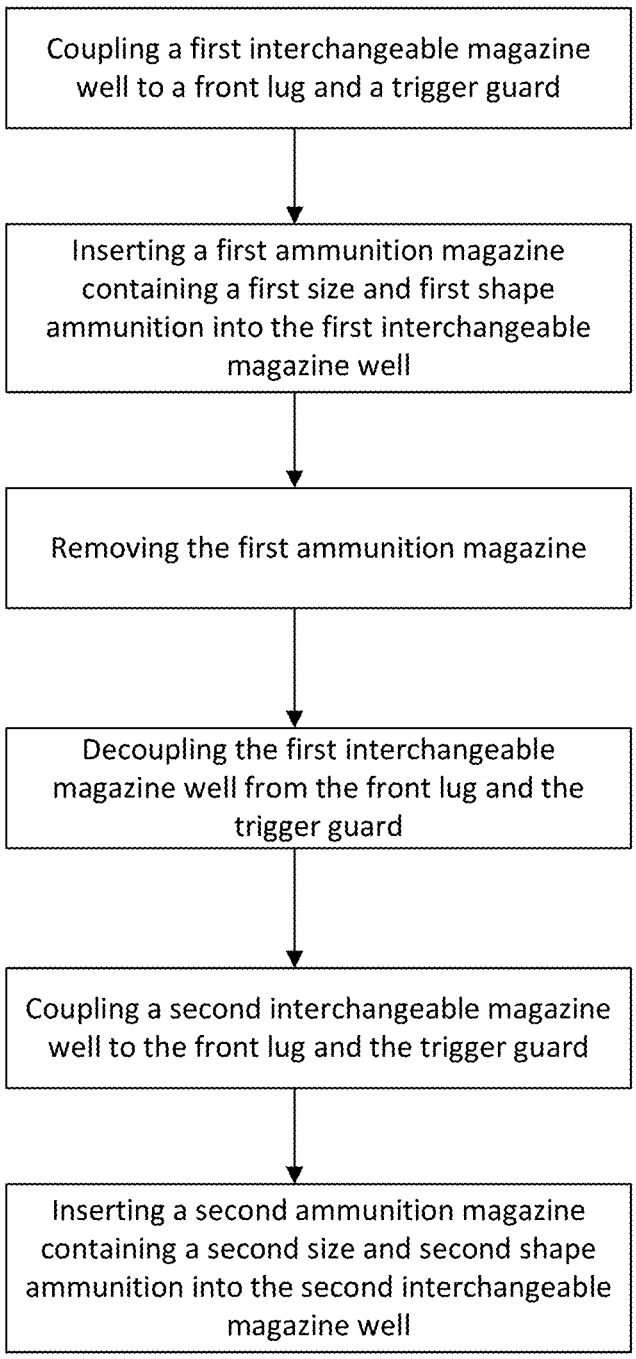
FIG. 6 illustrates a flowchart illustrating a method of assembling a firearm, in accordance with various embodiments.

A block diagram illustrating a method 600 of assembling a firearm is depicted in FIG. 6, in accordance with various embodiments. Method 600 may comprise coupling a first interchangeable magazine well to a front lug and a trigger guard. Method 600 may further comprise inserting a first ammunition magazine shape containing a first shape and first caliber ammunition into the first interchangeable magazine well chamber shape. Method 600 may further comprise removing the first ammunition magazine. Method 600 may further comprise decoupling the first interchangeable magazine well from the front lug and the trigger guard. Method 600 may further comprise coupling a second interchangeable magazine well to the front lug and the trigger guard. Method 600 may further comprise inserting a second ammunition magazine shape containing a second caliber and second shape ammunition into the second interchangeable magazine well chamber shape.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A lower receiver assembly configured to allow a single firearm to use different shaped magazines firing a variety of ammunitions having different shapes and calibers, the lower receiver assembly configured to couple to an upper receiver of the single firearm, the upper receiver comprising an ejection port, the lower receiver assembly comprising:

a front lug configured to couple to a forward portion of the upper receiver, the front lug comprising a front lug groove at a rearward portion thereof and a front lug aperture extending through walls on either side of the front lug groove;

a trigger guard portion configured to couple to a rearward portion of the upper receiver, the trigger guard portion comprising a trigger guard groove at a forward portion thereof and a trigger guard aperture extending through walls on either side of the trigger guard groove;

a first interchangeable magazine well housing comprising a first magazine chamber at an interior thereof, the first magazine chamber dimensioned to receive and hold a first ammunition magazine for holding ammunition of a specific shape and caliber, the first interchangeable magazine well housing further comprising a first flange comprising a first aperture at a forward portion thereof and a second flange comprising a second aperture at a rearward portion thereof;

wherein, when the front lug and the trigger guard portion are coupled to the upper receiver, the first interchangeable magazine well is configured to be removably coupled to the front lug and the trigger guard portion such that;

the first flange is received by the front lug groove and the front lug aperture and the first aperture are in alignment, and the second flange is received by the trigger guard groove and the trigger guard aperture and the second aperture are in alignment.

2. The lower receiver assembly of claim 1, further comprising:

a first mechanical fastener configured to extend into or through the aligned front lug aperture and first aperture of the first interchangeable magazine well, and a second mechanical fastener configured to extend into or through the aligned trigger guard aperture and second aperture of the first interchangeable magazine well.

3. The lower receiver assembly of claim 1, further comprising:

a second interchangeable magazine well housing comprising a second magazine chamber at an interior thereof, the second magazine chamber dimensioned to receive and hold a second ammunition magazine for holding ammunition of a specific shape and caliber that is different than the first ammunition magazine, the second interchangeable magazine well housing further comprising a first flange comprising a first aperture at a forward portion thereof and a second flange comprising a second aperture at a rearward portion thereof;

wherein, when the front lug and the trigger guard portion are coupled to the upper receiver, the second interchangeable magazine well is configured to be removably coupled to the front lug and the trigger guard portion such that;

the first flange is received by the front lug groove and the front lug aperture and the first aperture are in alignment, and the second flange is received by the trigger guard groove and the trigger guard aperture and the second aperture are in alignment.

4. A method of assembling a firearm receiver comprising:

providing an upper receiver comprising an ejection port;

providing the lower receiver assembly of claim 3;

coupling the front lug to a forward portion of the upper receiver;

coupling the trigger guard portion to a rearward portion of the upper receiver;

coupling the first interchangeable magazine well housing to the front lug and the trigger guard portion;

inserting a first ammunition magazine for holding ammunition of a specific shape and caliber into the first magazine chamber;

removing the first ammunition magazine;

decoupling the first interchangeable magazine well housing from the front lug and the trigger guard portion;

coupling the second interchangeable magazine well housing to the front lug and the trigger guard portion;

inserting a second ammunition magazine for holding ammunition of a specific shape and caliber that is different than the first ammunition magazine into the second magazine chamber.

* * * * *